US007780280B2

(12) United States Patent
Warren et al.

(10) Patent No.: US 7,780,280 B2
(45) Date of Patent: Aug. 24, 2010

(54) FLUID PORT SEAL WITH SURFACE HAVING CHANNELS

(75) Inventors: Daniel G. Warren, Rochester, NY (US); Terry L. Congdon, Fairport, NY (US); Douglas H. Pearson, Rochester, NY (US); Mark D. Perkins, Wayland, NY (US)

(73) Assignee: Eastman Kodak Company, Rochester, NY (US)

( * ) Notice: Subject to any disclaimer, the term of this patent is extended or adjusted under 35 U.S.C. 154(b) by 800 days.

(21) Appl. No.: 11/679,892

(22) Filed: Feb. 28, 2007

(65) Prior Publication Data

US 2008/0204525 A1 Aug. 28, 2008

(51) Int. Cl.
*B41J 2/175* (2006.01)

(52) U.S. Cl. ..... 347/86

(58) Field of Classification Search ..... 347/84–87
See application file for complete search history.

(56) References Cited

U.S. PATENT DOCUMENTS

| | | | | |
|---|---|---|---|---|
| 5,619,237 | A | 4/1997 | Inoue et al. | 347/86 |
| 6,302,531 | B1 * | 10/2001 | Usui et al. | 347/86 |
| 6,623,104 | B1 | 9/2003 | Kotaki et al. | 347/49 |
| 6,814,435 | B1 * | 11/2004 | Shimada et al. | 347/93 |

OTHER PUBLICATIONS

Eastman Kodak Company Docket No. 93513, USSN: Unassigned, filed: concurrently herewith, entitled: Ink Jet Ink Cartridge With Vented Wick, by Douglas H. Pearson, et al.

* cited by examiner

*Primary Examiner*—An H Do
(74) *Attorney, Agent, or Firm*—Justin D. Petruzzelli; Eugene I. Shkurko

(57) ABSTRACT

A seal for an ink-discharge port on a printer ink cartridge, according to various embodiments of the present invention, is disclosed. The seal has a surface containing channels that oppose a direction in which the port is configured to discharge ink from the ink cartridge. Such channels facilitate the retention of ink by the seal during removal of the seal, thereby reducing the likelihood of ink spillage during such removal.

23 Claims, 12 Drawing Sheets

FLUID PORT SEAL WITH SURFACE HAVING CHANNELS

FIELD OF THE INVENTION

This invention pertains to a seal for a fluid-discharge port on a fluid reservoir. The seal is configured to prevent loss of fluid from the fluid reservoir through the port, for example, during shipping or storage. In particular, this invention pertains to aspects of a surface of the seal that faces the port opening and opposes a direction in which the port is configured to discharge fluid. Such aspects improve, among other things, the retention of fluid on the surface of the seal during removal of the seal, thereby reducing spillage or splattering of fluid during removal of the seal.

BACKGROUND OF THE INVENTION

Fluid reservoirs, such as ink cartridges for ink jet printers, commonly have one or more fluid-discharge ports with an opening through which fluid is delivered during use. In order to prevent loss of fluid, for example by spillage or evaporation during shipping or storage, it is common to provide a seal for the port or each of the ports. When the seal is removed so that the fluid reservoir can be used, it is important not to spill or splatter droplets of the fluid.

Fluid-ejection printing devices, such as ink jet printers, commonly have at least one fluid reservoir (or ink cartridge) and a printhead chassis that supports the ink cartridge. The ink cartridge may contain one or more fluid chambers that provide fluid to a printhead. If the ink cartridge has more than one ink chamber, each such chamber often retains fluid of a different color or function for multi-color printing. On the other hand, if the ink cartridge has only a single ink chamber, typically such chamber is used to retain a single fluid, such as black ink for black-and-white printing.

The printhead die containing the nozzles is typically connected directly or indirectly to the chassis. In order to form an image, the printhead die, along with the chassis and the ink cartridge, generally are moved in a lateral direction across a width of a substrate, such as paper, as fluid is ejected from the printhead. After the printhead forms a row-portion of the image along the width of the substrate, the substrate is advanced in a direction perpendicular to the lateral direction along a length of the substrate, so that the printhead can form a subsequent row-portion of the image. This process of advancing the substrate for each row-portion is repeated until a next substrate is needed or the image is completed.

When an ink chamber in the ink cartridge runs out of ink, a user is charged with the responsibility of removing the empty ink cartridge from the chassis and replacing it with a full ink cartridge. The task of replacing an ink cartridge must be simple and clean. Ink should not be allowed to stain the user's hands or clothes, and it also must not be allowed to drip into areas of the printer where it might cause damage.

When a new ink cartridge is shipped, a shipping seal is provided to seal the fluid discharge port(s). The shipping seal helps to prevent ink evaporation during long-term storage, as well as ink spillage due to air pressure changes that occur, for example, during air travel. However, subsequent to shipping, conventional seals have been found to allow fluid to splatter during a user's removal of the seal, thereby possibly causing staining or damage. Accordingly, a need in the art exists for a solution that mitigates the risk of fluid splatter during removal of a shipping seal from an ink cartridge.

SUMMARY

The above-described problem is addressed and a technical solution is achieved in the art by a seal for a fluid-discharge port on a fluid reservoir, according to various embodiments of the present invention. The seal has a surface containing channels that oppose a direction in which the port is configured to discharge fluid. Such channels facilitate the retention of fluid by the seal during removal of the seal, thereby reducing the likelihood of fluid spillage.

At least one of the channels may have a smallest dimension, such as a width of approximately 0.05 mm to 0.25 mm. At least one of the channels may have a rounded or substantially rounded bottom. And, at least one of the channels may have a pointed or substantially pointed bottom.

According to various embodiments of the present invention, at least some of the channels may intersect at right angles, at substantially right angles, or obliquely. According to various embodiments of the present invention, the channels may be formed between protrusions. The protrusions may comprise a sloped side wall. In addition, the protrusions may include sloped side walls that form a point, substantially a point, an edge, or substantially an edge. In this case, the smallest dimension of the point or edge may be approximately 0.05 mm or 0.25 mm. According to an embodiment of the present invention, the protrusions may comprise rounded or substantially rounded tops.

According to various embodiments of the present invention, the protrusions may have approximately a first height and the seal may further include a containment wall around or substantially around a periphery of the seal, such that the containment wall has a height approximately greater than or equal to the first height. A width of a top surface of the containment wall may be approximately between 1 mm and 2 mm. The containment wall may have an outside edge that is stepped, and the outside edge may include a plurality of steps.

According to various embodiments of the present invention, the seal may include a storage area configured to retain excess fluid from the reservoir. In this case, the surface of the seal may include openings communicatively connected to the storage area. The storage area may be located beneath the surface.

According to various embodiments of the present invention, the seal may be formed of a compressible material, such as EPDM rubber or a thermoplastic elastomer, known in the art. The seal may be a hydrophilic material.

According to various embodiments of the present invention, a printer ink cartridge is provided, the printer ink cartridge including a fluid reservoir, a fluid-discharge port, a porous media, and a seal according to one of the various embodiments of the present invention highlighted above. The porous media is positioned in the port. According to these embodiments, the surface of the seal includes (a) protrusions between which are the channels, and (b) a containment wall around or substantially around a periphery of the seal. Also according to these embodiments, a space may exist between the protrusions and the porous media, and a space may exist between the containment wall and the porous media.

In addition to the embodiments described above, further embodiments will become apparent by reference to the drawings and by study of the following detailed description.

BRIEF DESCRIPTION OF THE DRAWINGS

The present invention will be more readily understood from the detailed description of exemplary embodiments presented below considered in conjunction with the attached drawings, of which.

It is to be understood that the attached drawings are for purposes of illustrating the concepts of the invention and may not be to scale.

DETAILED DESCRIPTION

Embodiments of the present invention provide one or more channels in the surface of a sealing member which faces the opening of a port of a fluid reservoir. Although particular examples of a fluid reservoir often are provided in the context of an ink jet ink cartridge, it is to be understood that the invention is applicable more generally to sealing members for ports of fluid reservoirs.

Figure 1:
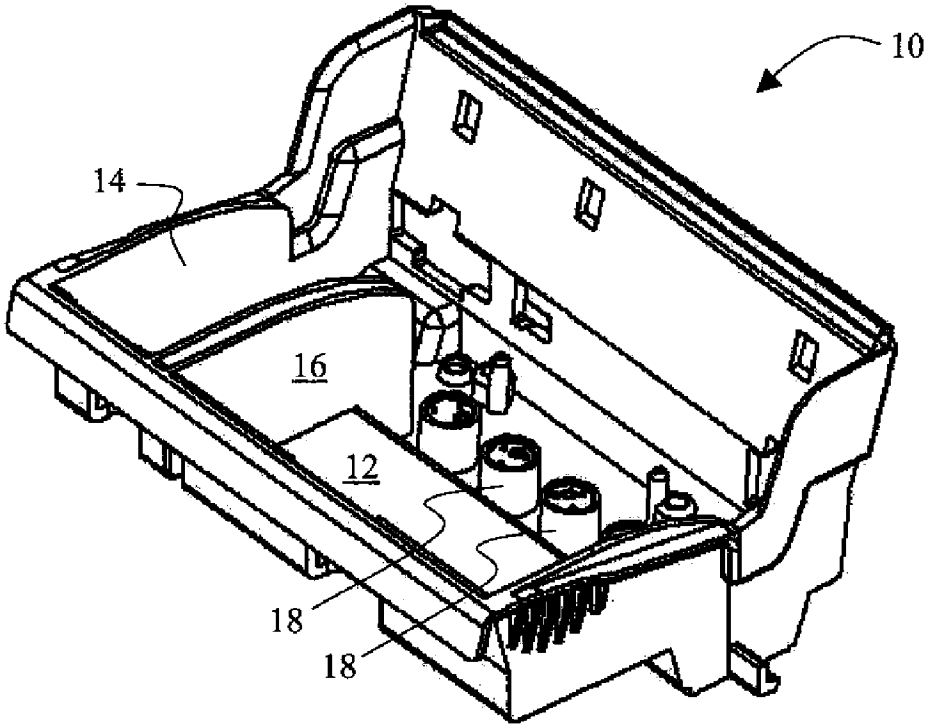
FIG. 1 illustrates a printhead chassis for retaining one or more print cartridges.

FIG. 1 illustrates a printhead chassis 10 having a region 12 for a multi-chamber ink cartridge, and also a region 14 for a single-chamber ink cartridge. Regions 12 and 14 are separated by one or more partitions 16 which also serve as guides for inserting the ink cartridges into the printhead chassis. In region 12, several fluid reception ports 18 are shown which make connection with the corresponding fluid discharge ports of a multi-chamber ink cartridge, when the ink cartridge is inserted. Region 14 also has a single fluid reception port (hidden by partition 16) corresponding to the fluid discharge port of a single-chamber ink cartridge. Not shown in the view of FIG. 1 is the printhead die and its nozzles. Typically, the printhead die would be located underneath the printhead chassis, in a region below the fluid reception ports 18.

Figure 2:
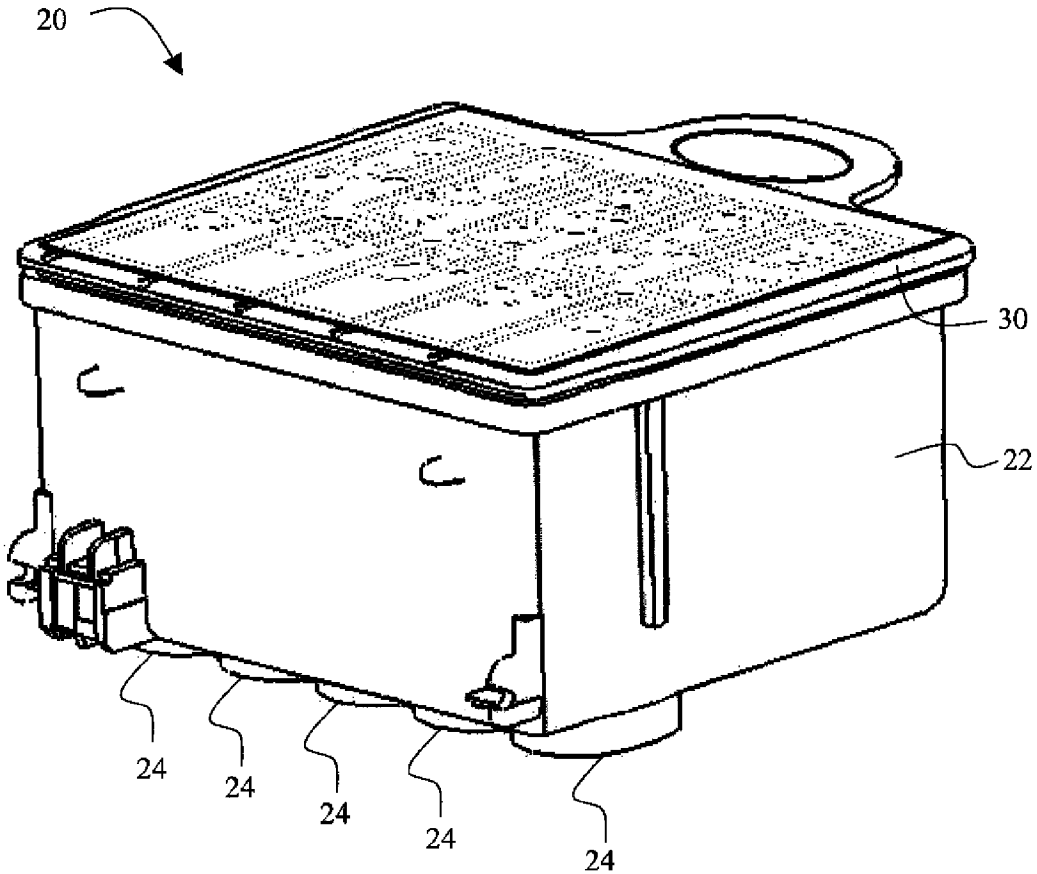
FIG. 2 shows an isometric view of a multi-chamber ink cartridge.

FIG. 2 shows an isometric view of a multi-chamber ink cartridge 20 which may be inserted into region 12 of printhead chassis 10. The particular ink cartridge 20 shown in FIG. 2 has five chambers within reservoir body 22, each chamber of which leads to a fluid discharge port 24. The five chambers serve as reservoirs intended to hold five fluid sources. The five sources may be, for example, cyan ink, magenta ink, yellow ink, photo black ink, and a protective fluid. Alternatively, they may be cyan ink, light cyan ink, magenta ink, light magenta ink, and yellow ink; or they may be a different combination of fluids. Ink cartridge 20 is shown as having a lid 30 in the example shown in FIG. 2. Lid 30 may be affixed to reservoir body 22. Together, lid 30 and reservoir body 22 make up the ink cartridge body. Typically the lid 30 and the reservoir body 22 are each formed by injection molding.

Figure 3:
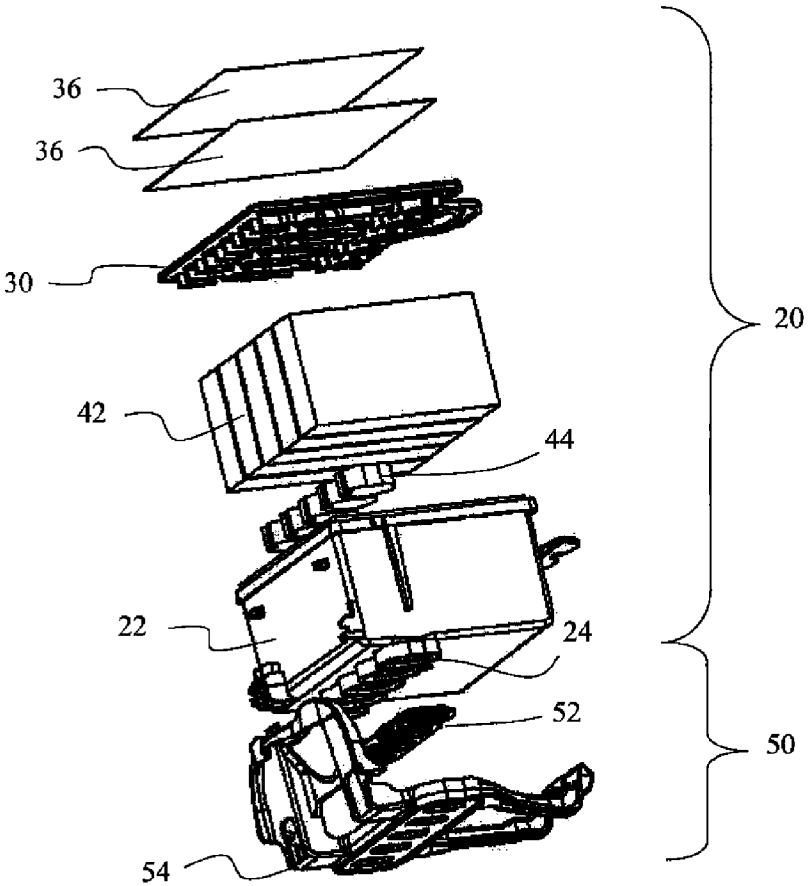
FIG. 3 shows an exploded view of a multi-chamber ink cartridge.

FIG. 3 shows an exploded view of multi-chamber ink cartridge 20 as well as seal assembly 50. For the particular example shown in FIG. 3, pressure regulation for the ink cartridge is provided by capillary media 42 and wick 44, as is described in greater detail in the co-filed application titled "Ink Jet Ink Cartridge with Vented Wick", by Pearson, et al., application Ser. No. 11/679,925, filed Feb. 28, 2007. Both the capillary media and the wick are typically formed of porous media, such as foam, or felt, or fiber bundles. However, the wick and capillary media are not essential features for this invention. Lid 30 is affixed to reservoir body 22 by ultrasonic welding or other means of adhering the lid to the reservoir body 22. One or more labels 36 may optionally be applied to the top surface of the lid 30. Ink or fluids of various types are typically held in the various chambers of the ink cartridge.

Figure 4:
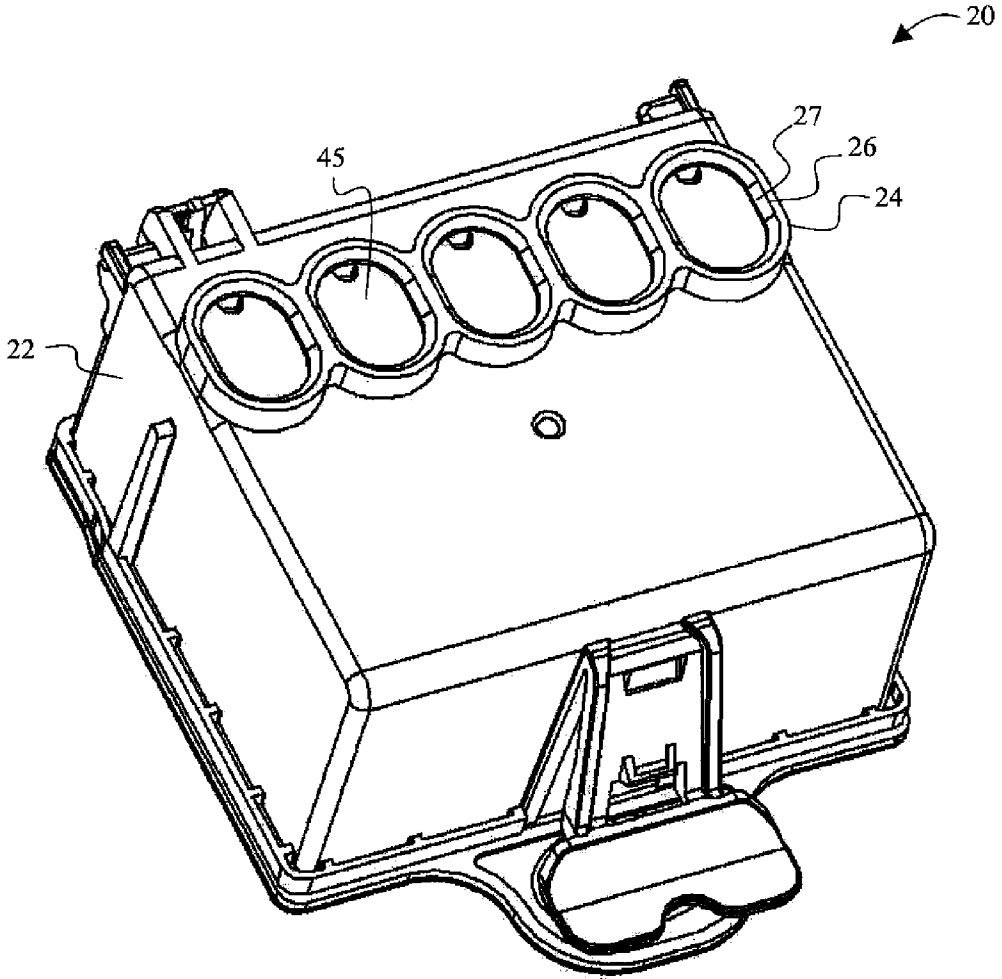
FIG. 4 shows a bottom view of a multi-chamber ink cartridge.

FIG. 4 shows a bottom view of multi-chamber ink cartridge 20 with the bottom surface 45 of each wick 44 visible within each port 24. Note that the bottom surface 45 of wick 44 is recessed somewhat relative to the outer rim (or bottom surface) 26 of port 24.

Before the ink cartridge 20 is ready to be shipped to the customer, the ports must be sealed in order to prevent leakage or excessive evaporation of volatile ink components. Many different styles of seals are possible to be used. For example, a film may be affixed to the outer rim of each port. For this type of seal, the customer may pull a tab at an end of the film and thereby pull the seal away from each port. A second alternative is a twist-off seal, although this type of seal is more compatible with a cartridge having only a single port. With a row of ports 24 as in multi-chamber ink cartridge 20, the amount of torque to twist off seals from five adjacent chambers would be excessively difficult for the user to apply. A third alternative is a seal of the type provided by seal assembly 50 shown in FIG. 3. Seal assembly 50 includes a compliant seal member 52 which is held in place at the ports 24 by seal retainer 54. Compliant seal member 52 is typically is formed using an elastomeric material such as EPDM rubber. Seal retainer 54 is typically formed by injection molding. The sealing member may protrude somewhat into the port, but typically there is still an air space between the bottom surface 45 of wick 44 and the sealing member. A fourth alternative is to use the compliant seal member without a seal retainer. In such an alternative, the elastic properties of the seal member material would be used to hold it in place—for example, by having a portion of the seal member material surround the outer rim of the port(s) to hold the seal member in place.

Figure 5:
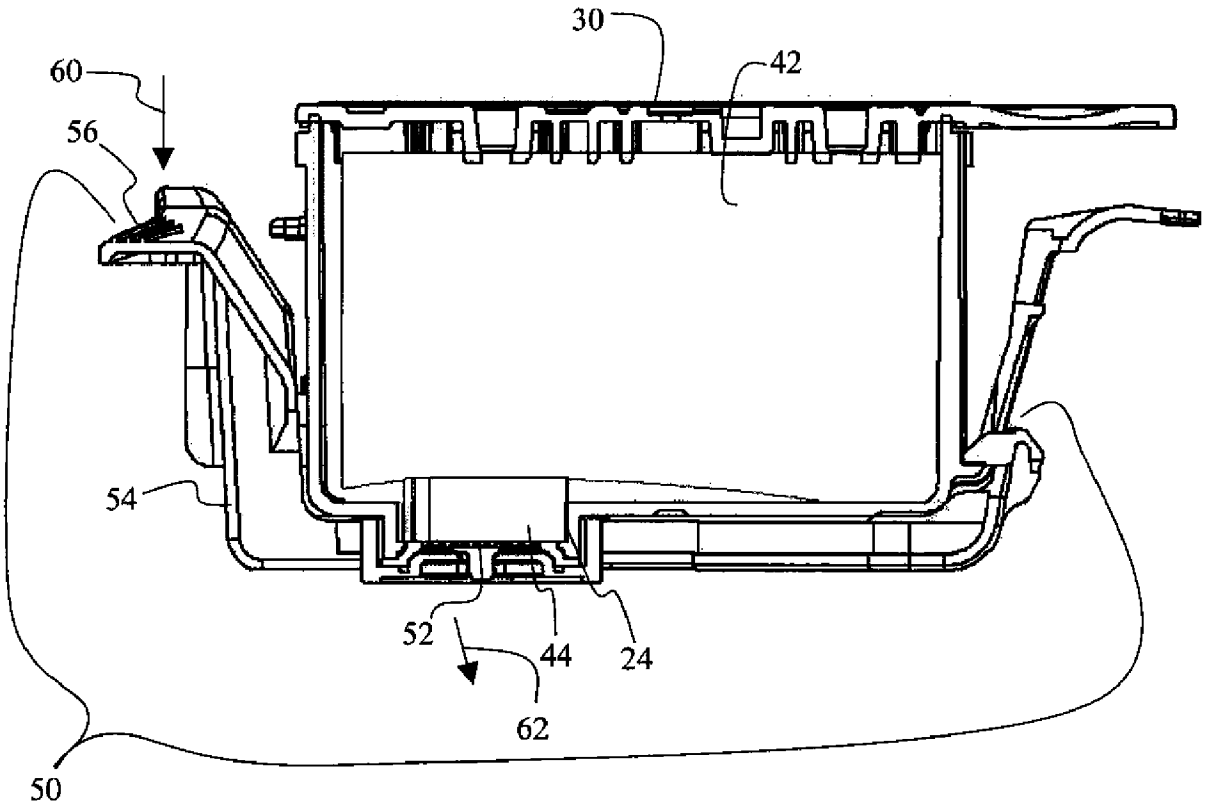
FIG. 5 shows a side view of a fluid reservoir with a sealing member held in place against the port opening by a seal retainer.

FIG. 5 shows a cutaway side view of ink cartridge 20 with seal assembly 50 installed in order to prepare it for shipping and other fluid-retention purposes. Sealing member 52 is shown pressed against port 24 and held in place by seal retainer 54. In order to remove seal retainer 54, the user presses on seal retainer lever 56 in a downward direction denoted by arrow 60. As a result, the sealing member 52 is pulled away from outer rim 26 of fluid discharge port 24 in a direction denoted by arrow 62.

As the sealing member 52 is pulled away from the port, some amount of ink may be located on the surface of the sealing member which had faced the port opening and which opposed a direction in which the port 24 is configured to discharge ink. If the seal is pulled away suddenly, droplets of ink may splatter out and stain the hands of the user or get onto the printer or other objects. This is true whether the seal is a compliant seal such as sealing member 52, or whether the seal is an adhesively affixed film. This problem, which is addressed by the present invention, is exacerbated for configurations of fluid reservoirs and seals such that transient pressure changes occur when the seal is removed, due to air volume changes between the port and the surface of the seal. Somewhat less susceptible to such pressure changes are the types of seals which may be removed in a twisting motion, since the volume change is very small as the seal is broken. However, as mentioned above, twist-off type seals are not very compatible with multi-chamber ink cartridges having a row of adjacent ports 24.

Figure 6:
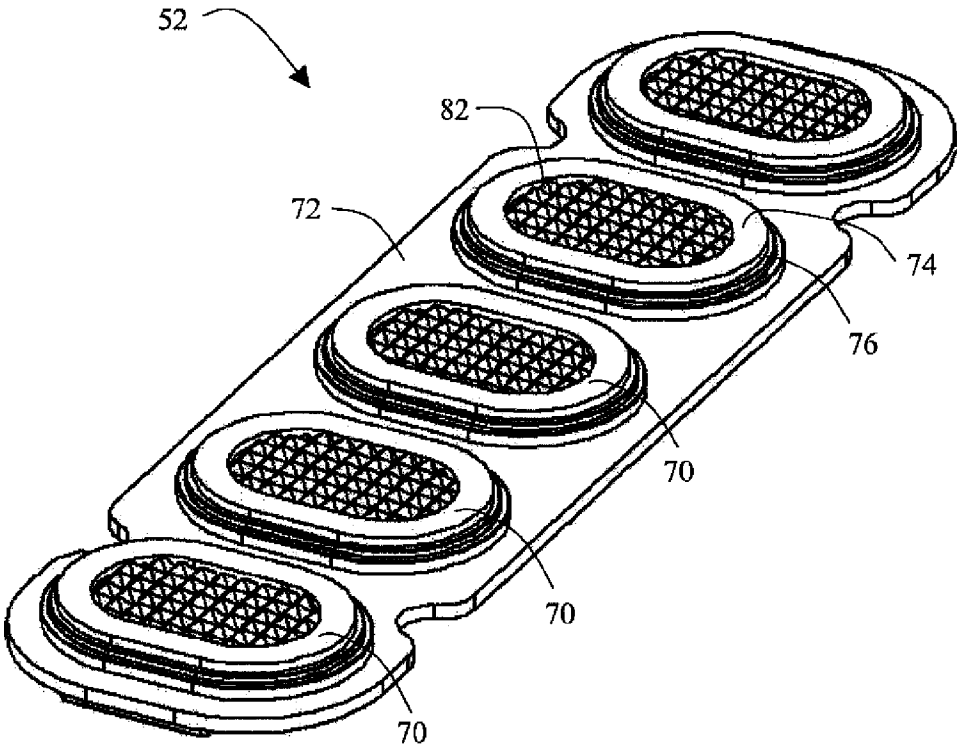
FIG. 6 shows an isometric view of a sealing member, according to an embodiment of the present invention.

FIG. 6 shows an isometric view of a sealing member 52 according to an embodiment of this invention. In the example shown in FIG. 6, sealing member 52 is configured with five port seals 70 (corresponding to five ports of a five-chamber fluid reservoir). The port seals 70 are joined by and extend from a sealing member base top surface 72. The port seals may include a containment wall 74 having a flat top surface and/or a stepped edge 76. Within the region surrounded by containment wall 74 may be a plurality of protrusions 82 which are separated from one another by channels 84 (see also the top view shown in FIG. 8).

In a preferred embodiment, the sealing member 52 is formed of a compressible material, such as EPDM rubber or a thermoplastic elastomer. The port seals 70 are configured such that each containment wall 74 fits within the outer rim 26 of the corresponding fluid discharge port 24. When the sealing member 52 is pressed against the fluid discharge ports 24 (for example by seal retainer 54), it is the stepped edge 76 that provides the seal against the inner surface 27 of the outer rim 26. Although not required, providing a plurality of steps in stepped edge 76 can improve seal reliability. A function of containment wall 74, protrusions 82 and channels 84 is to retain residues of ink or other fluid which may be on the surface of the port seal 70 when the sealing member 52 is removed from the fluid discharge ports 24. The channels 84 between the protrusions 82 provide capillary forces, which tend to hold the fluid residue, as well as some amount of storage volume, so that the fluid has less tendency to splatter off the surface of the port seal 70 when the sealing member 52 is removed from the fluid discharge ports 24. In some applications, for example, when the inks or fluids are water-based, the surface of the sealing member 52 may be made of a hydrophilic material to provide additional holding forces for the fluid residue.

Figure 7:
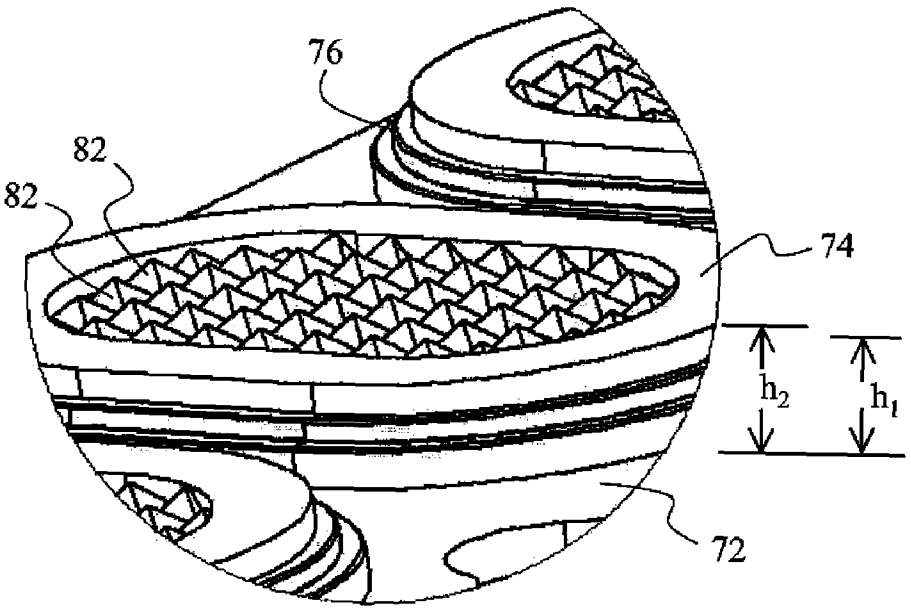
FIG. 7 shows close-up isometric view of a portion of a sealing member, according to an embodiment of the present invention.

FIG. 7 shows a close-up isometric view of a portion of sealing member 52 in order to provide a better view of the containment wall 74, the protrusions 82, and the stepped edge 76. In the embodiment shown in FIG. 7, the protrusions 82 are shown as pyramid-shaped, with sloping walls. The height of the protrusions 82 relative to the top surface 72 of the sealing member 52 is $h_1$. The height of containment wall 74 relative to the top surface 72 of the sealing member 52 is $h_2$. In some embodiments, it is advantageous for fluid retention if the height of containment wall 74 is greater than or equal to the height of protrusions 82. In other words, $h_2 \geqq h_1$. Further, in some embodiments, it is advantageous for the interference of the stepped edge 76 against the inner surface 27 of outer rim 26 to be such that neither the protrusions 82 nor the containment wall 74 touch any solid feature with fluid discharge port 24, such as a wick 44 or capillary media 42.

Figure 8:
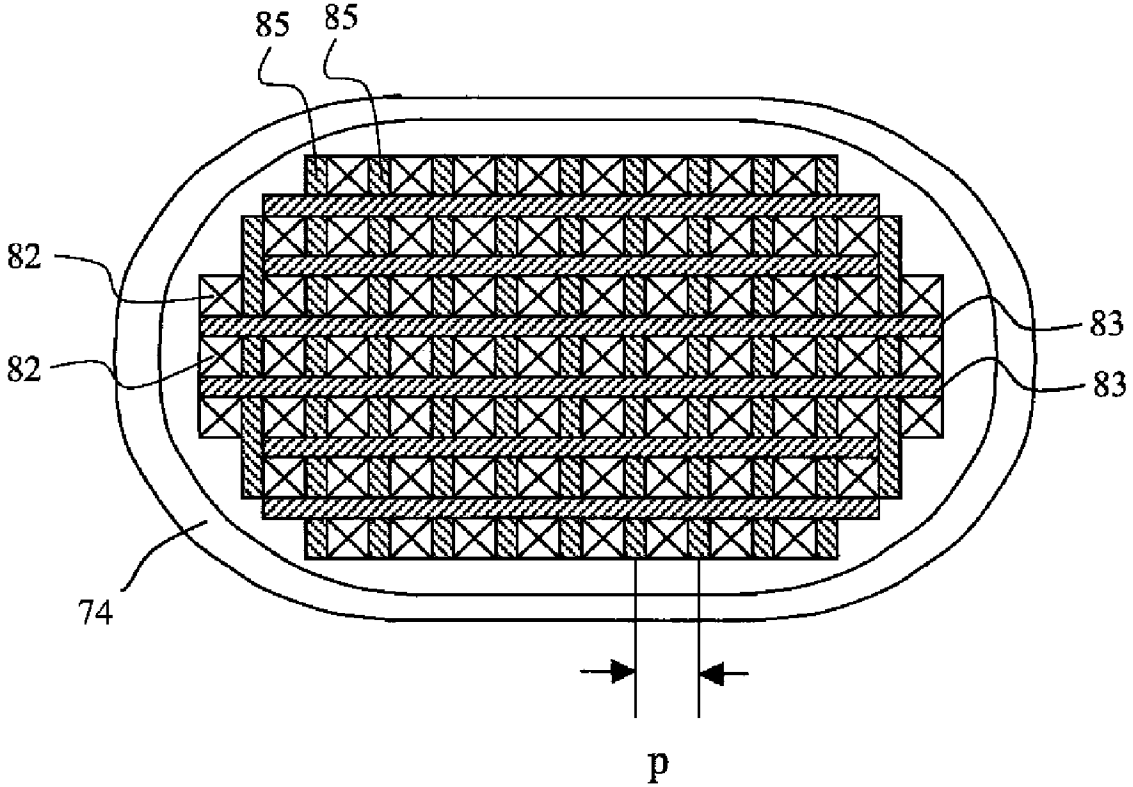
FIG. 8 shows a top view of a portion of a sealing member, according to an embodiment of the present invention.

FIG. 8 shows a top view of a port seal 70 to show the two-dimensional array of protrusions 82 and channels 84. In the embodiment shown in FIG. 8, the protrusions 82 in the two-dimensional array are separated from neighboring protrusions 82 by a series of horizontal channels 83 and vertical channels 85. In this example, the channels are shown as intersecting at right angles, but they can alternatively intersect obliquely. In fact, channels may be configured in a spiral pattern, for example, and not intersect at all. The primary requirement is that the channels 84 and protrusions 82 have geometries conducive to providing capillary forces to promote the retention of fluid on the surface when the sealing member 52 is removed from the fluid discharge ports 24.

Further geometrical details of shapes and dimensions will be discussed with reference to FIG. 7-11. The distance between adjacent channels (pitch p shown in FIG. 8) is typically on the order of 1 mm, but may range, for example, between 0.3 mm and 2 mm. The height $h_1$ of protrusions 82 is typically on the order of 0.5 mm. The width of the top surface of containment wall 74 ranges between approximately 1 mm and 2 mm.

Figure 9:
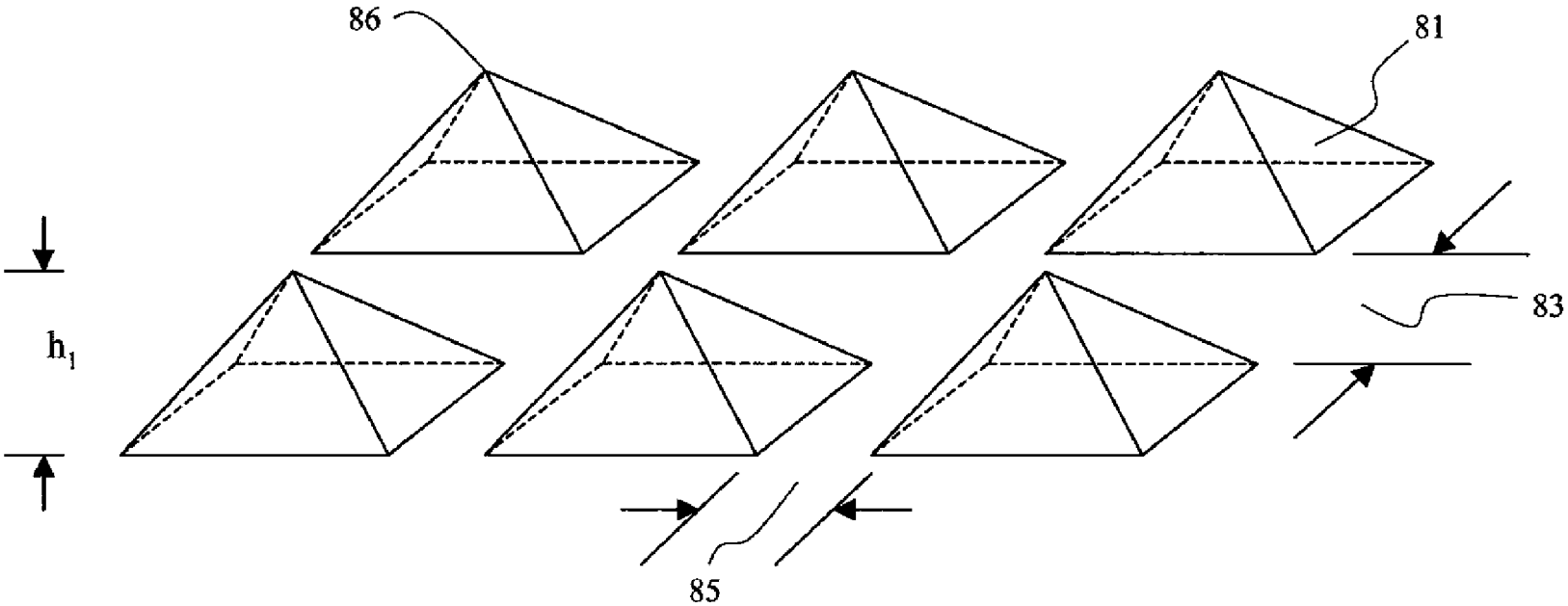
FIG. 9 shows a close-up isometric view of an array of protrusions and channels on the surface of a sealing member, according to an embodiment of the present invention.

FIG. 9 shows a close-up isometric view of several protrusions 82 and channels 84. In the embodiment of FIG. 9 each protrusion 82 consists of four sloping sidewalls 81 which meet at a point 86. In other words, the protrusions are pyramid shaped. The horizontal channels 83 and the vertical channels 85 are shown in the example of FIG. 9 to have sharp corners and well defined widths. It is not required that the width of the horizontal channels 83 and the width of the vertical channels 85 be equal to each other.

Figure 10:
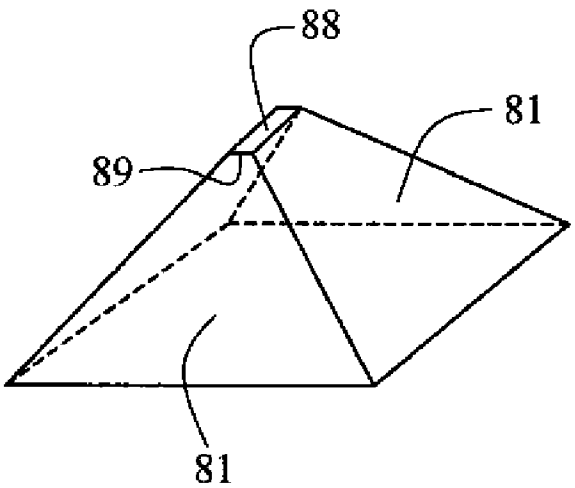
FIG. 10 shows a close-up isometric view of protrusions having a top edge which may be sharp or flat or rounded, according to embodiments of the present invention.
Figure 10:
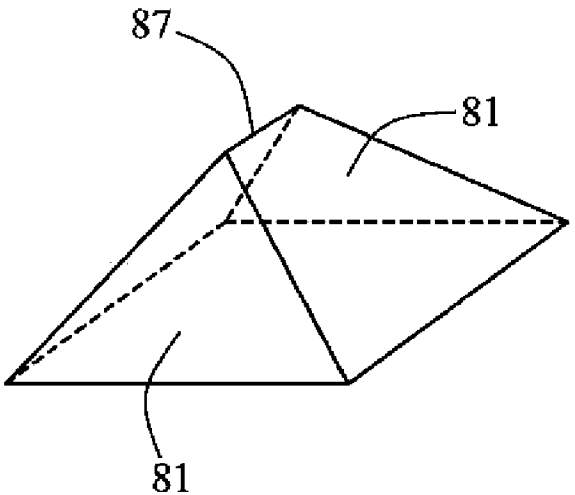

FIG. 10 shows a close-up isometric view of other alternative shapes for protrusions 82. For example, rather than meeting at point 86, the sloping sidewalls 81 may meet at an edge or line 87. In other words, the protrusion 82 can be tent-shaped. Alternately the protrusion 82 may be truncated at the top to provide a flat or rounded surface 88. A smallest dimension of the top of the protrusion 82 is shown as 89. Whether the top of the protrusion is a point, an edge, or a flat or rounded surface, a typical smallest dimension of the top of the protrusion 82 ranges from 0.05 mm to 0.25 mm.

Figure 11:
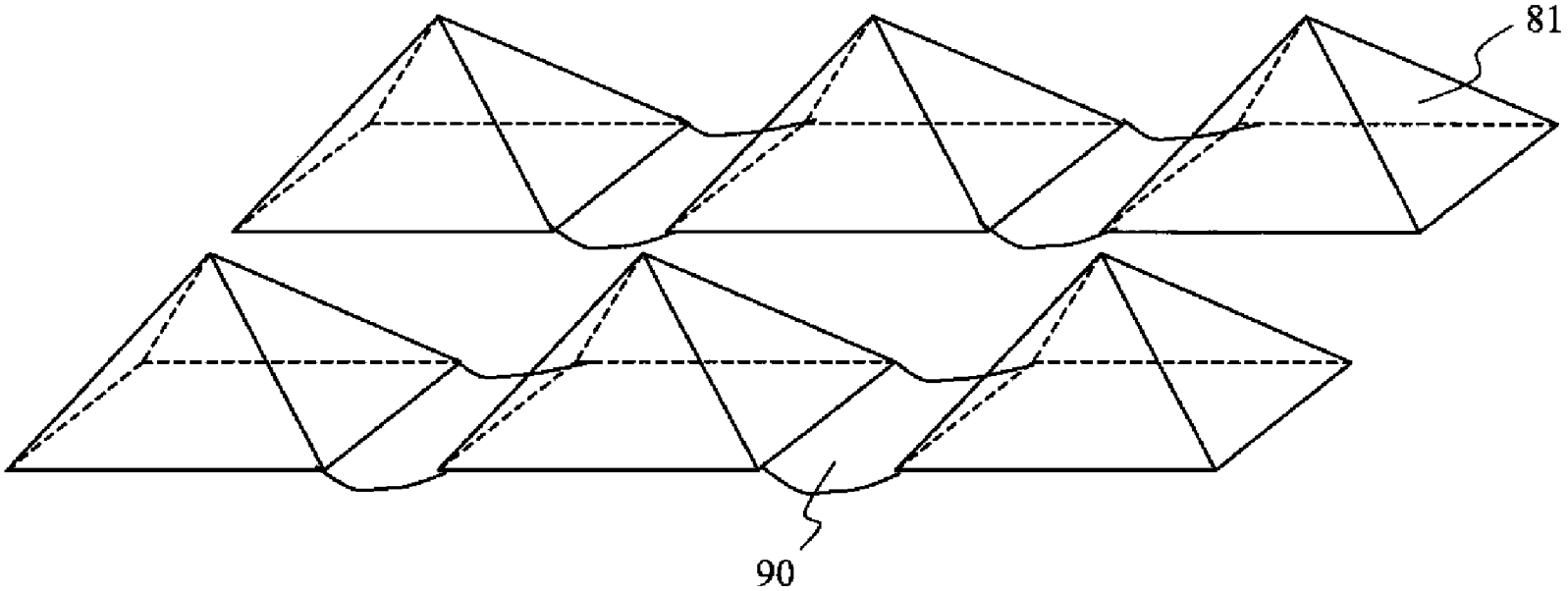
FIG. 11 shows a close-up isometric view of an array of protrusions and channels with rounded bottoms on the surface of a sealing member, according to an embodiment of the present invention.

FIG. 11 shows a close-up isometric view of an alternate shape for channels 84. In FIG. 11, rather than the channels 84 having a flat bottom, they have a rounded bottom 90. Other non-flat channel options include V-shaped channels. In any case, the smallest dimension, such as a width, of the channels typically ranges from approximately 0.05 mm to 0.25 mm.

Figure 12:
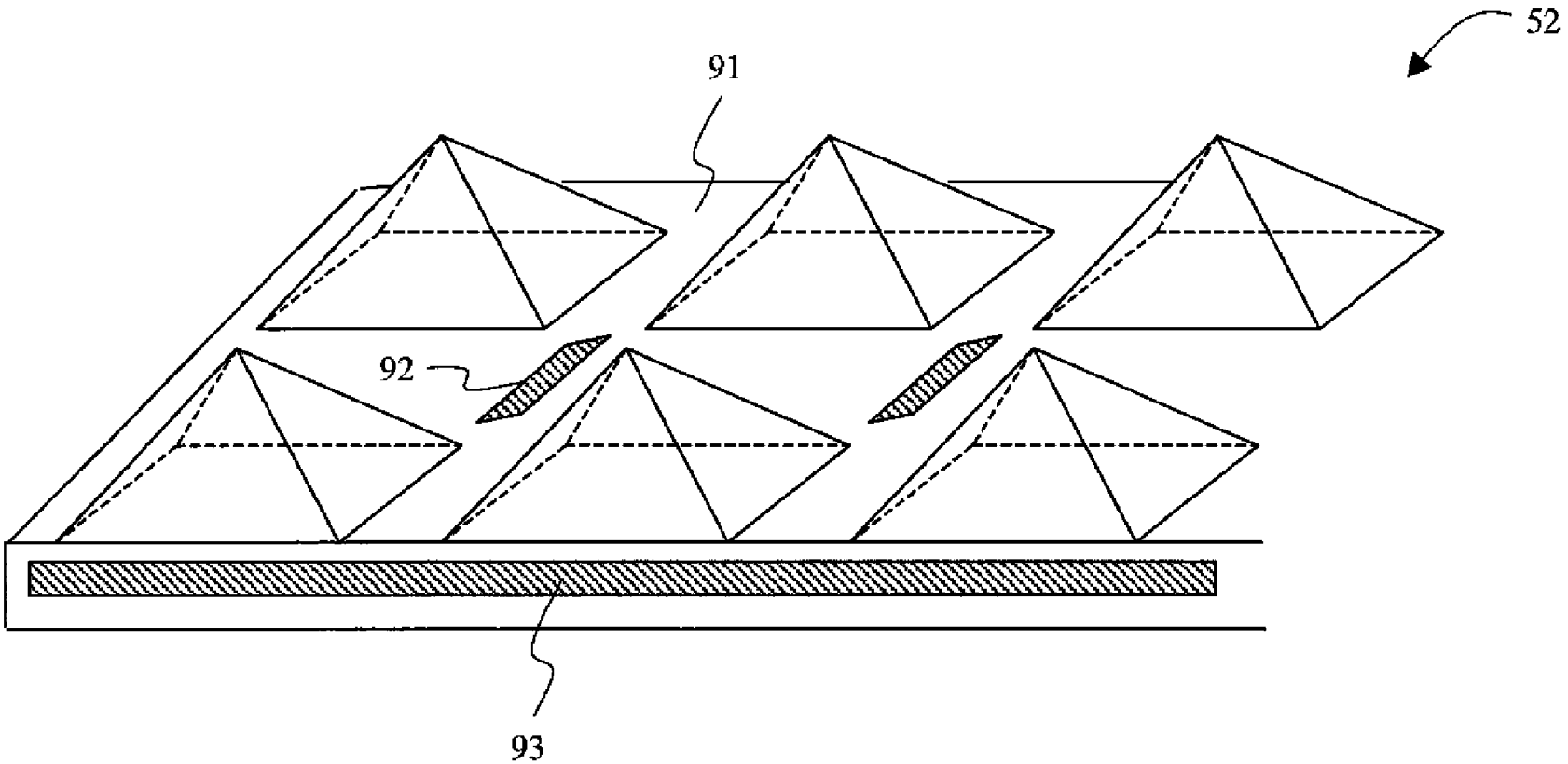
FIG. 12 shows a close-up isometric view of an array of protrusions and channels with openings in the surface of a sealing member, according to an embodiment of the present invention.

FIG. 12 shows a close-up isometric view (with a sliced open front edge) of a sealing member 52 having increased storage capacity for fluid residue. FIG. 12 shows a portion of sealing member 52 in the region of the protrusions 82 and channels 84 for an alternative embodiment of the invention. In this embodiment, openings 92 are provided in the surface 91 of the channels 84. Openings 92 lead to a storage region 93 within sealing member 52 in which additional fluid may be stored.

Although the examples above discuss embodiments in a multi-chamber fluid reservoir 20, it is to be understood that the same advantages apply to a single chamber fluid reservoir.

The various embodiments of this invention are particularly advantageous for, among other things, fluid reservoirs and sealing members such that the sealing member is removed in a fashion that momentarily increases the air volume between the sealing member and the interior of the fluid discharge port, such that a transient reduction of air pressure occurs within the fluid discharge port. Such configurations are particularly susceptible to fluid residue being transferred to the surface of the sealing member, resulting in ink splatters if the surface cannot hold the residue. For example, embodiments of the present invention are particularly advantageous for, among other things, seals which are not removed by twisting them off.

It is to be understood that the exemplary embodiments are merely illustrative of the present invention and that many variations of the above-described embodiments can be devised by one skilled in the art without departing from the scope of the invention. It is therefore intended that all such variations be included within the scope of the following claims and their equivalents.

PARTS LIST

| | |
|---|---|
| 10 | Printhead chassis |
| 12 | Region for multi-chamber cartridge |
| 14 | Region for single chamber cartridge |
| 16 | Partition |
| 18 | Fluid reception port |
| 20 | Multi-chamber ink cartridge |
| 22 | Reservoir body |
| 24 | Fluid discharge port |
| 26 | Outer rim of fluid discharge port |
| 27 | Inner surface of outer rim |
| 30 | Lid |
| 36 | Label |
| 42 | Capillary media |
| 44 | Wick |
| 45 | Bottom surface of wick |
| 46 | Wick opening |
| 50 | Seal assembly |
| 52 | Seal member |
| 54 | Seal retainer |
| 56 | Seal retainer lever |
| 60 | Direction arrow |
| 62 | Direction arrow |
| 70 | Port seal |
| 72 | Sealing member base |
| 74 | Containment wall |
| 76 | Stepped edge |
| 81 | Sloping sidewalls of protrusions |
| 82 | Protrusions |
| 83 | Horizontal channels |
| 84 | Channels |
| 85 | Vertical channels |
| 86 | Point of protrusions |
| 87 | Edge intersection of protrusions |
| 88 | Truncated top of protrusion |
| 89 | Smallest dimension of protrusion |
| 90 | Rounded bottom of channel |
| 91 | Surface of channel |
| 92 | Opening |
| 93 | Storage region |

What is claimed is:

1. A seal for a port on a reservoir, the reservoir configured to retain fluid and the port configured to discharge the fluid from the reservoir, the seal comprising a surface configured to face an opening in the port and configured to oppose a direction in which the port is configured to discharge the fluid, the surface comprising channels, wherein at least one of the channels is formed between protrusions, and wherein the protrusions have approximately a first height and the seal further comprises a containment wall around a periphery of the seal, the containment wall having a height greater than or equal to the first height or approximately greater than or equal to the first height.

2. The seal of claim 1, wherein the seal is configured to be removed from the port without twisting.

3. The seal of claim 1, wherein the seal is formed of a compressible material.

4. The seal of claim 3, wherein the seal is formed of EPDM rubber or a thermoplastic elastomer.

5. The seal of claim 1, wherein the surface is formed of a hydrophilic material.

6. The seal of claim 1, wherein the smallest dimension of at least one of the channels is approximately 0.05 mm to 0.25 mm.

7. The seal of claim 1, wherein a pitch of the channels is between 0.3 mm and 2 mm.

8. The seal of claim 1, wherein at least one of the channels has a rounded or substantially rounded bottom.

9. The seal of claim 1, wherein at least some of the channels intersect.

10. The seal of claim 9, wherein the channels intersect at right angles or substantially right angles.

11. The seal of claim 9, wherein the channels intersect obliquely.

12. The seal of claim 1, wherein the protrusions each comprise a sloped side wall.

13. The seal of claim 12, wherein the protrusions each have sloped side walls forming a point, substantially a point, an edge, or substantially an edge at a top of each protrusion.

14. The seal of claim 13, wherein the smallest dimension of the point or edge is approximately 0.05 mm to 0.25 mm.

15. The seal of claim 1, wherein the protrusions comprise rounded or substantially rounded tops.

16. The seal of claim 1, further comprising a containment wall around or substantially around a periphery of the seal.

17. The seal of claim 16, wherein an outside edge of the containment wall is stepped.

18. The seal of claim 17, wherein the outside edge of the containment wall comprises a plurality of steps.

19. The seal of claim 16, wherein a width of a top surface of the containment wall is approximately between 1 mm and 2 mm.

20. The seal of claim 1, further comprising:

a storage area configured to retain excess fluid from the reservoir; and openings in the surface communicatively connected to the storage area.

21. The seal of claim 20, wherein the storage area is located beneath the surface.

22. A printer ink cartridge comprising:

an ink cartridge body;

a reservoir within the ink cartridge body, the reservoir being configured to retain fluid;

a port configured to discharge the fluid from the reservoir, the port including a wall that is disposed external to the ink cartridge body; and a manually removable seal, the seal configured to be installed by pressing a portion of a surface of the seal against the external wall of the port, wherein the surface of the seal comprises channels to promote the retention of fluid on the surface when the seal is manually removed from the port.

23. A seal for a port on a reservoir, the reservoir configured to retain fluid and the port configured to discharge the fluid from the reservoir, the seal comprising a surface configured to face an opening in the port and configured to oppose a direction in which the port is configured to discharge the fluid, the surface comprising a plurality of intersecting channels and a plurality of protrusions, the channels formed at the bases of the protrusions, the protrusions and the channels for providing capillary forces sufficient to retain fluid on the surface.

* * * * *